US005205773A

United States Patent [19]

Koepcke et al.

[11] Patent Number: 5,205,773

[45] Date of Patent: Apr. 27, 1993

[54] DEFORMABLE TOY STRUCTURE WITH INVERTED MOUTH

[75] Inventors: Ingrid M. Koepcke, Lakewood; Michael A. Robertson, Cleveland, both of Ohio; Richard E. Knight, Dubuque, Iowa; Edward G. Chanter, Lakewood; Thomas G. Barnum, Reading, both of Ohio

[73] Assignee: Those Characters From Cleveland, Cleveland, Ohio

[21] Appl. No.: 792,964

[22] Filed: Nov. 15, 1991

[51] Int. Cl.[5] ..... A63H 3/06; A63H 13/00; A63H 29/00; F41B 11/00

[52] U.S. Cl. ..... 446/183; 446/198; 446/429; 124/64

[58] Field of Search ..... 446/176, 180, 183, 184, 446/185, 188, 192, 197, 198, 398, 399, 429, 475, 483, 486, 487; 124/56, 63, 64; 273/129 AP

[56] References Cited

U.S. PATENT DOCUMENTS

| | | | |
|---|---|---|---|
| 494,410 | 3/1893 | Carpenter . | |
| 1,352,047 | 9/1920 | Boje, Jr. | 446/183 |
| 1,567,973 | 12/1925 | Mendelson | 446/198 |
| 2,631,407 | 3/1953 | Rempel | 446/185 |
| 2,668,394 | 2/1954 | Auzin | 446/183 |
| 2,853,991 | 9/1958 | McLain | 124/64 |
| 2,960,794 | 11/1960 | Johns | 446/183 |
| 3,087,481 | 4/1963 | Foster | 124/64 |
| 3,353,823 | 11/1967 | Sobel | 446/183 X |
| 3,577,676 | 5/1971 | Powell | 446/183 |
| 3,870,304 | 3/1975 | Minnick | 124/56 X |
| 4,149,338 | 4/1979 | Wolf | 446/186 |
| 4,194,303 | 3/1980 | Heller | 446/183 X |
| 4,240,224 | 12/1980 | Katzman et al. | 446/197 |
| 4,580,991 | 4/1986 | Renger et al. | 446/320 |
| 4,757,999 | 7/1988 | Opresco | 273/129 AP X |

FOREIGN PATENT DOCUMENTS

| | | | |
|---|---|---|---|
| 1027624 | 5/1953 | France | 446/198 |
| 1469080 | 3/1977 | United Kingdom | 124/63 |

OTHER PUBLICATIONS

Pictures of "Slimer" toy.

Packaging from "Brain Blaster" toy manufactured for Kenner Parker Toys, Inc.

*Primary Examiner*—Robert A. Hafer

*Assistant Examiner*—D. Neal Muir

*Attorney, Agent, or Firm*—Calfee, Halter & Griswold

[57] ABSTRACT

A squeeze toy has an outer body formed of generally resiliently deformable material which defines a main cavity. A portion of the body extends inwardly into the main cavity to form a receptacle. The receptacle includes a mouth which is dimensioned to enable a projectile to be inserted into and be supported by the receptacle. The receptacle has a configuration which normally causes an interference fit with the projectile to retain the projectile in the receptacle and prevent the receptacle from being removed through the mouth. The body of the squeeze toy can be deformed to cause a portion of the receptacle to be forced outward through the mouth and eject the projectile from the body.

27 Claims, 4 Drawing Sheets

DEFORMABLE TOY STRUCTURE WITH INVERTED MOUTH

TECHNICAL FIELD

The present invention relates generally to resiliently deformable toys, and more particularly to a resiliently deformable toy which is designed to eject a projectile from a receptacle formed in the body of the toy.

BACKGROUND

Toys are generally designed to provide amusement and entertainment for children. To this end, some toys have a resiliently deformable body which can be temporarily squeezed into another shape. The toys generally resume their original shape once the pressure is released on the body. Moreover, some of these toys have animated features (e.g., grotesque, humorous, etc.) on the body, which further adds some degree of fascination for the child while the toy is being squeezed.

For example, one known type of toy is shown in Auzin, U.S. Pat. No. 2,668,394. The Auzin patent illustrates a toy having a generally resilient body with an airtight inner cavity. Upon deforming the body of the toy, the air in the inner cavity forces integral body members to bulge outwardly from recesses (e.g., eye sockets, mouth holes, etc.) formed in the body. When the pressure is released on the body, these integral body members return to their normal locations within the recesses. One of the recesses in Auzin comprises a sac which is initially formed outside of the body and reversed after the molding process so that it is contained within the body of the toy. The sac is designed to be filled with water and to eject the water in a stream through the mouth hole when the body is squeezed.

Accordingly, although a variety of toys have been developed which entertain and amuse children, there is a constant demand in the industry for new and useful toys, and in particular, for toys which have certain deformable properties.

SUMMARY OF THE INVENTION

The present invention provides a new and useful deformable toy which is entertaining and amusing for children. The toy is designed to eject a projectile from a receptacle formed in the toy when the body of the toy is deformed, i.e., squeezed. The deformable toy entertains and amuses children because of its ability to eject the projectile, as well as because of certain animated features formed on the outer surface of the body.

The body of the toy is formed of generally resilient material e.g., a PVC-type material, which defines a main cavity. A portion of the body extends inwardly into the main cavity of the body to form a receptacle. The receptacle includes a mouth which is dimensioned to enable the projectile to be located within and be supported by the receptacle. The receptacle has a configuration which normally causes an interference fit with the projectile to retain the projectile in the receptacle and prevent the receptacle from being removed through the mouth.

The resilient body of the toy is designed to be squeezably deformed by hand. When the body is squeezed, the air or other fluid pressure within the body increases. When the body is sufficiently squeezed and the pressure within the body becomes great enough, at least a portion of the receptacle is forced outward through the mouth to eject the projectile.

When the squeezing pressure on the body is released, the body returns to its initial shape, except that a portion of the receptacle may remain outside the mouth. If this occurs, the receptacle may be easily pushed back through the mouth into its initial location within the cavity of the body. The projectile can then be located again within the receptacle to provide further amusement and entertainment for the child.

Both the body of the toy and the projectile can be formed with certain animated features on the outer surfaces thereof, for example, a face or a body. Accordingly, when the projectile is ejected from the receptacle in the body, it appears that the animated toy is "spitting out" the projectile. The interrelation between the structure of the toy and the animated features increases the child's enthusiasm for the toy.

According to an additional aspect of the invention, the receptacle in the body includes a hole dimensioned to receive a specially designed key that protrudes from the projectile. When the hole in the receptacle is plugged by the key, the pressure in the body increases when the body is squeezed. The key holds the projectile in the receptacle until the pressure in the body becomes high enough that the receptacle is forced outward through the mouth to eject the projectile. However, if the hole is not plugged, such as if an object other than the projectile with the specially designed key is located in the receptacle, the hole prevents pressure from increasing within the body when the toy is squeezed, and hence the object will not be ejected from the toy.

Accordingly, it is a basic object of this invention to provide a resiliently deformable toy which is entertaining and amusing for a child.

It is another object of the present invention to provide a toy which is designed to support and retain a projectile in a receptacle and to eject the projectile from the receptacle when the body of the toy is squeezed.

It is still another object of the present invention to provide a resiliently deformable toy having certain animated features which makes it appear that the toy is "spitting out" a projectile when the body of the toy is deformed.

It is yet another object of this invention to provide a resiliently deformable toy which prevents other objects besides a certain projectile from being ejected from a receptacle in the toy.

Further objects of the present invention will become apparent from the following detailed description and accompanying drawings.

DETAILED DESCRIPTION OF THE PREFERRED EMBODIMENT

Figure 1B:
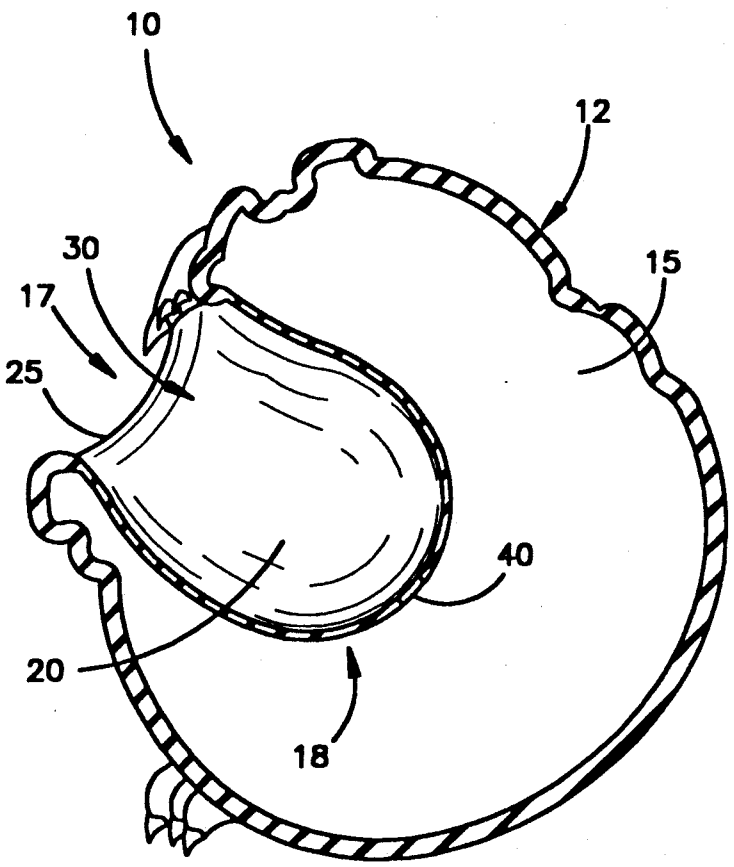
FIG. 1B is a cross-sectional side view of the deformable body taken substantially along the plane indicated by the lines 1B—1B of FIG. 1A.
Figure 1A:
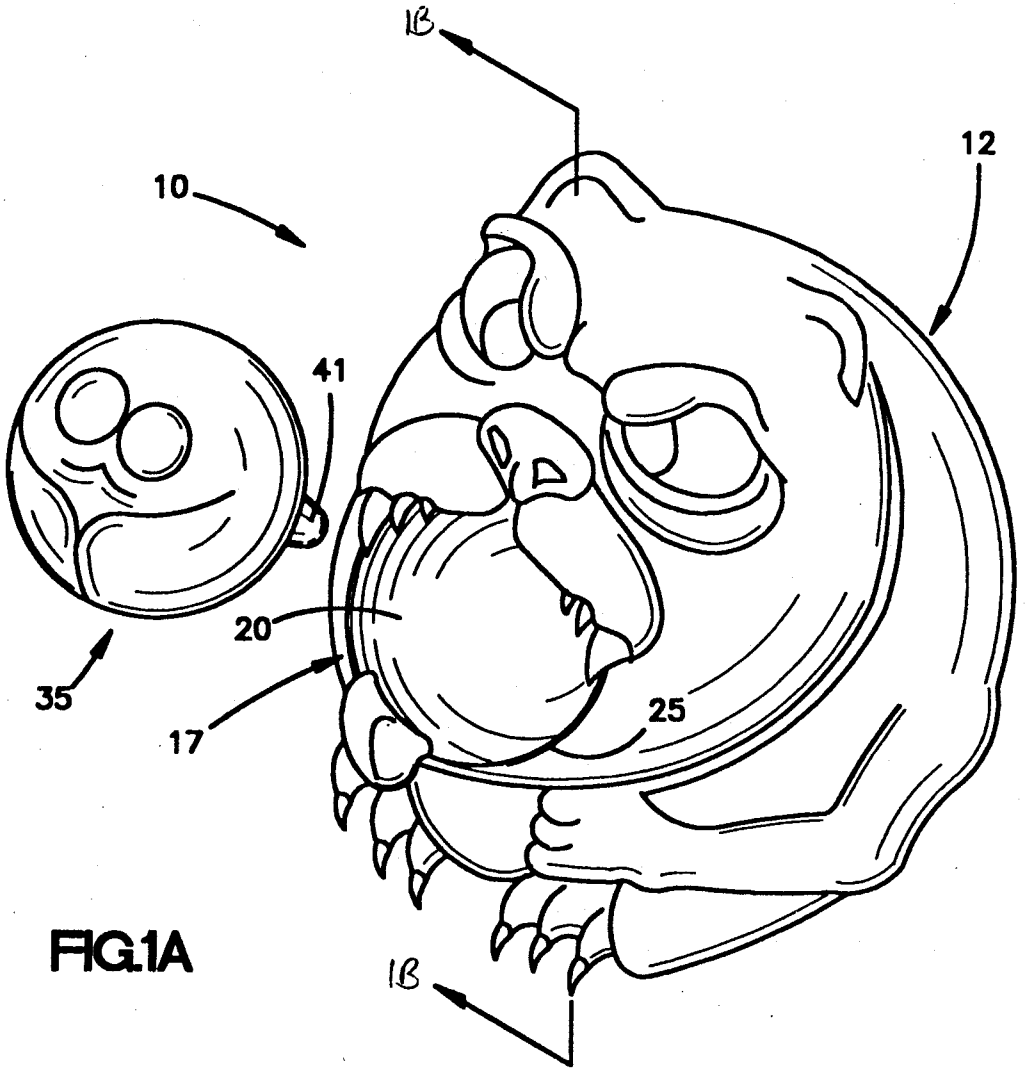
FIG. 1A is a perspective view of a toy including a deformable body and a projectile constructed according to the present invention.

Referring to FIGS. 1A and 1B, a toy 10 is designed to entertain and amuse children. To this end, the toy 10 includes a body 12 preferably having a generally spherical or round configuration. The body 12 is formed from generally resiliently deformable material, e.g., a PVC-type material. The body can be formed in one piece or in a plurality of pieces joined together to define a substantially airtight main cavity 15. The processes for forming the body of the toy are known to those skilled in the toy art using conventional techniques, e.g., rotocast or die-molding.

A portion of the body, for example as indicated generally at 17, normally extends inwardly into the main cavity 15. The body portion 17 can be formed using conventional molding techniques and is integrally formed with the remainder of the body 12. The body portion 17 forms a receptacle 18, having a wall 19, which defines a subcavity 20.

The receptacle 18 has an open end which is defined by a generally annular mouth 25 formed in one piece with the body 12. The outer portion of the body around the mouth 25 has a certain degree of thickness which provides support and integrity for the receptacle 18.

The body 12 may have animated features molded or otherwise formed on the outer surface thereof e.g., a face or a body. The animated features form an integral part of the structure of the body. For example, the mouth 25 is preferably incorporated into the animated features of the toy, for example as the mouth of a dog.

The receptacle 18 in the body is designed to receive and support a projectile 35. The projectile 35 is generally spherical in shape and can be formed from PVC or other appropriate resilient material. Preferably, the projectile 35 has certain animated features which are also formed or molded thereon, for example the features of a cat.

Figure 2B:
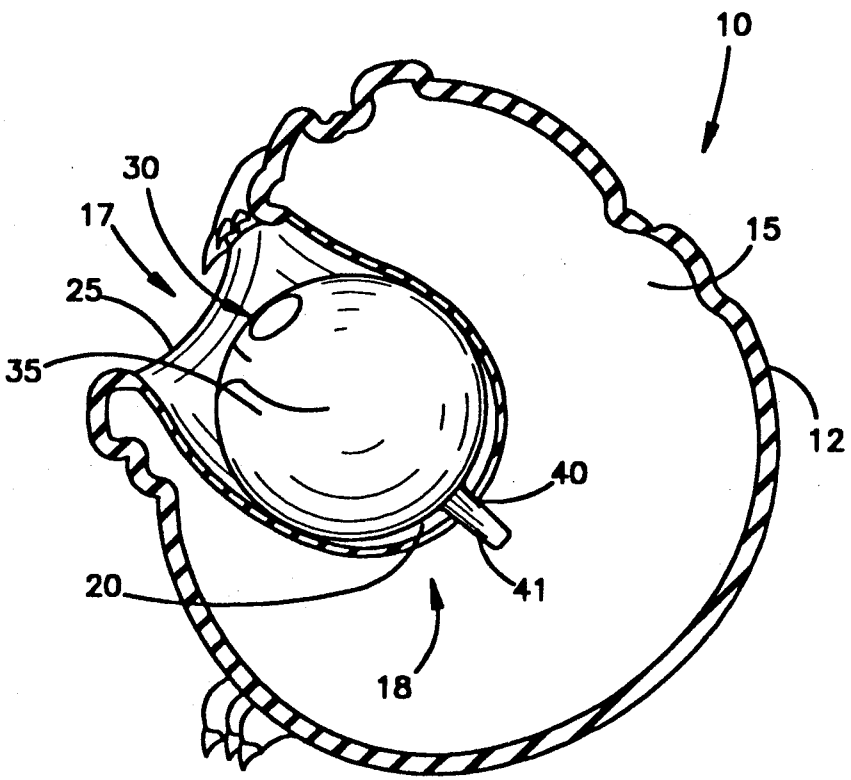
FIG. 2B is a cross-sectional side view of the toy taken substantially along the plane indicated by the lines 2B—2B of FIG. 2A.
Figure 2A:
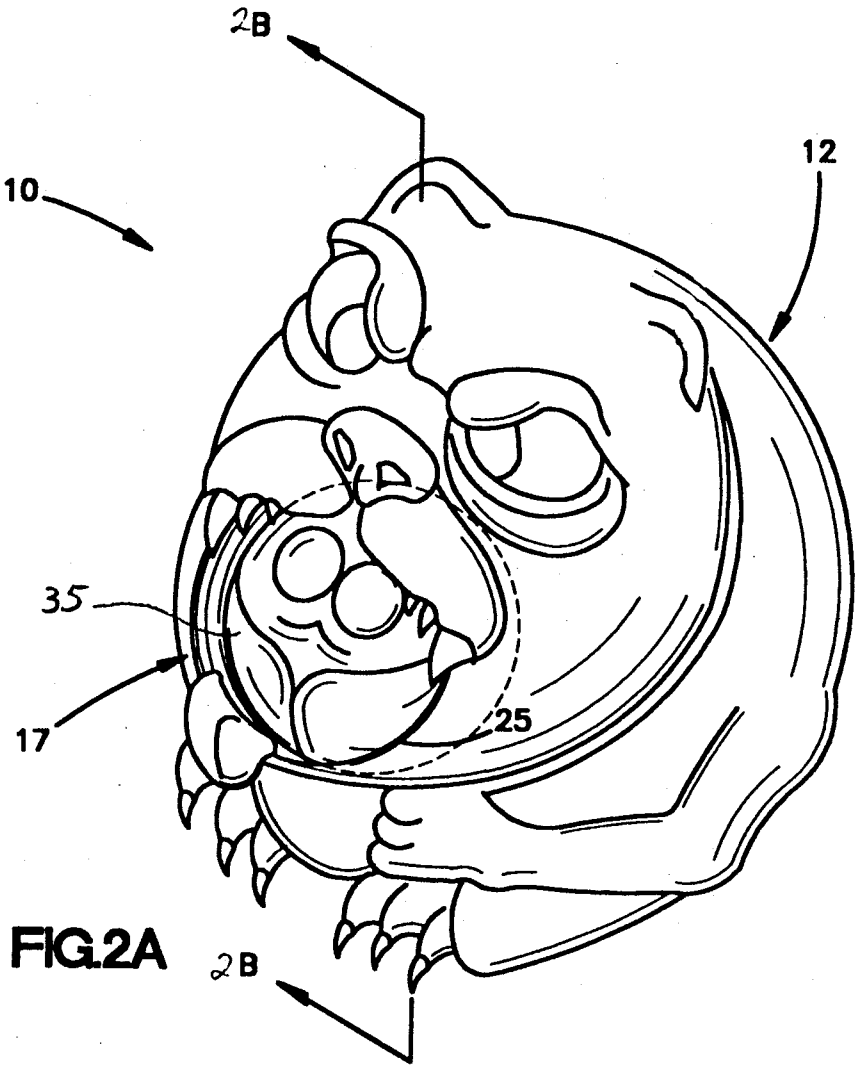
FIG. 2A is a perspective view of the toy of FIG. 1, with the projectile located within the receptacle in the body.

As illustrated in FIGS. 2A, 2B, the projectile 35 is designed to be located within the subcavity 20 of the receptacle 18. Preferably, the projectile 35 has an outer dimension which is slightly larger than the inner dimension of the mouth 25. The projectile 35 is initially forced through the mouth 25, and the resiliency of the projectile and of the mouth 25 allow the projectile to pass through the mouth and be received and supported within the subcavity of the receptacle 18. The slightly larger dimension of the projectile 35 with respect to the mouth 25 prevents the projectile from unintentionally falling out of the receptacle, for example if the toy is tilted or held upside-down. In other words, the receptacle has a configuration which normally causes an interference fit with the projectile to retain the projectile in the receptacle and prevent the receptacle from being removed through the mouth.

Figure 3B:
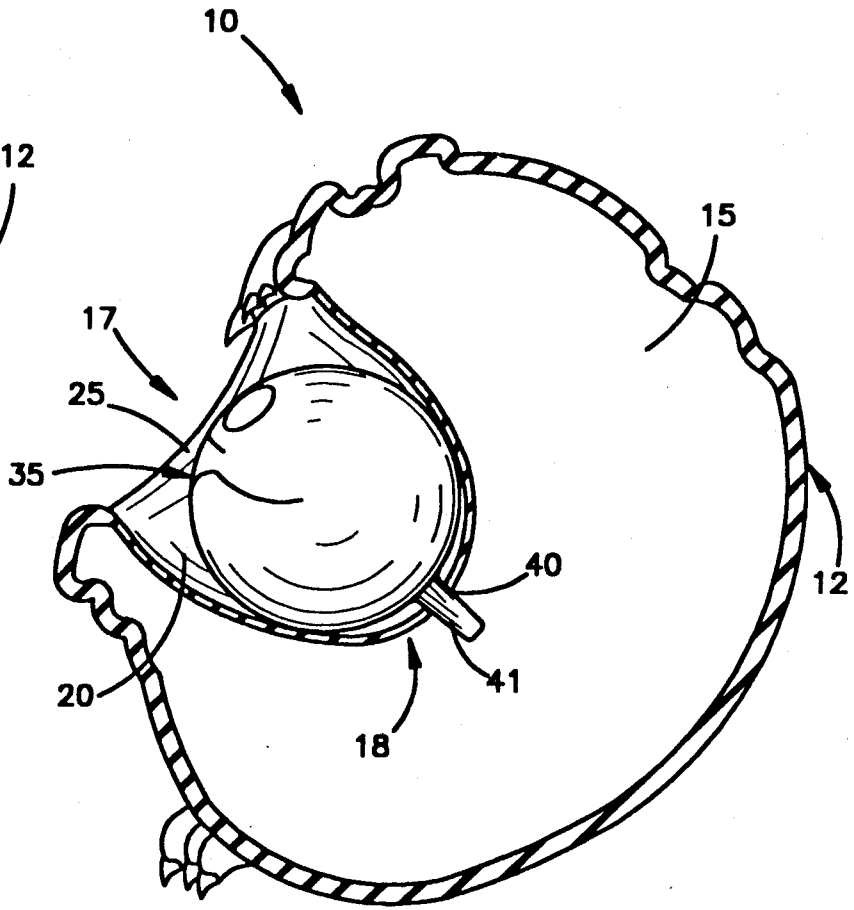
FIG. 3B is a cross-sectional side view of the toy taken substantially along the plane indicated by the lines 3B—3B of FIG. 3A.
Figure 3A:
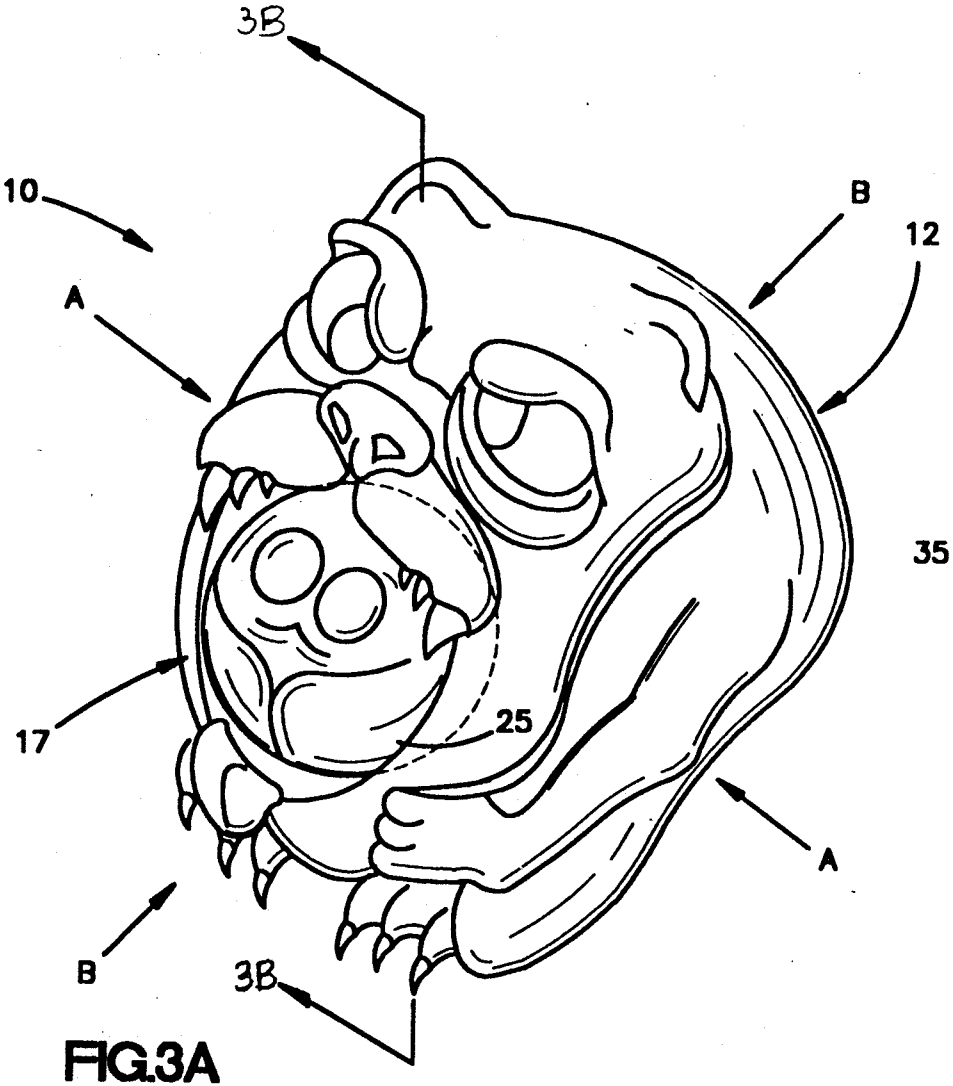
FIG. 3A is a perspective view of the toy of FIG. 1, showing the body in an initial state of deformation.

Referring now to FIGS. 3A, 3B, the body 12 of the toy 10 is preferably designed to be deformed (i.e., squeezed) in either a generally lateral or longitudinal direction, indicated by the arrows marked "A" and "B", respectively. When the body is deformed in this manner, at least a portion of the receptacle wall 19 is forced outward through the mouth 25. The forcing of the receptacle wall through the mouth is due in part to the increase in air pressure within the cavity 15 of the deformed body. The increase in pressure forces the slightly thinner receptacle wall material outward through the mouth 25. Although it is preferred that the body is filled with air, it is believed to be equally acceptable to fill the body with a fluid other than air, e.g., water or gel, and still have the receptacle forced outward through the mouth when the body is squeezed.

Figure 4B:
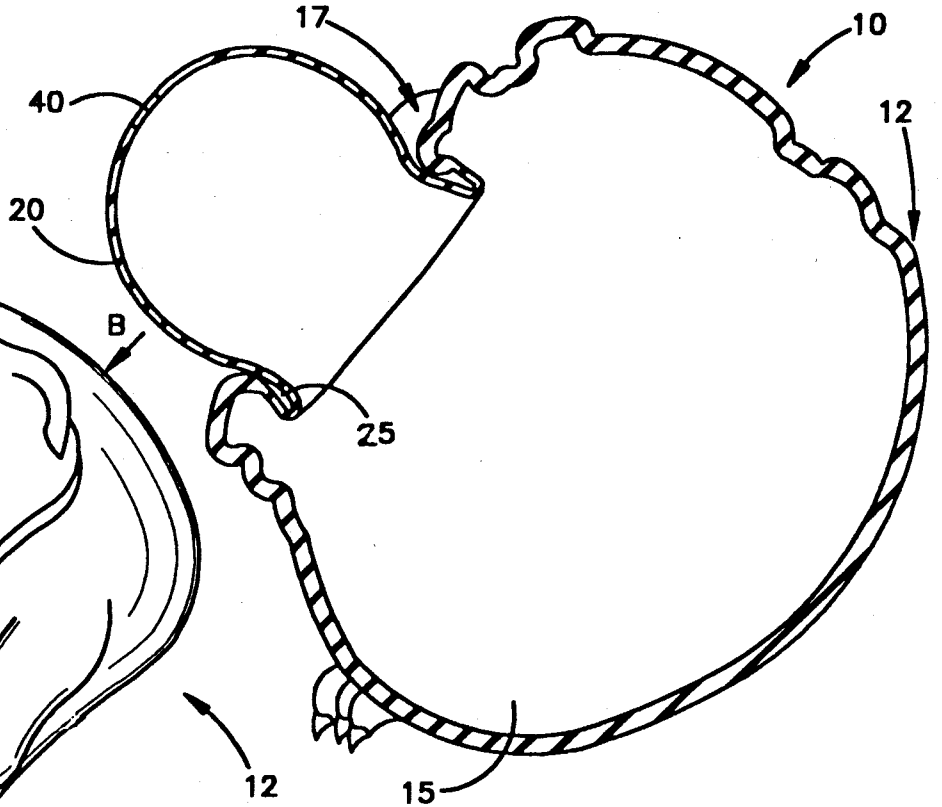
FIG. 4B is a cross-sectional side view of the toy taken substantially along the plane indicated by the lines 4B—4B of FIG. 4A.
Figure 4A:
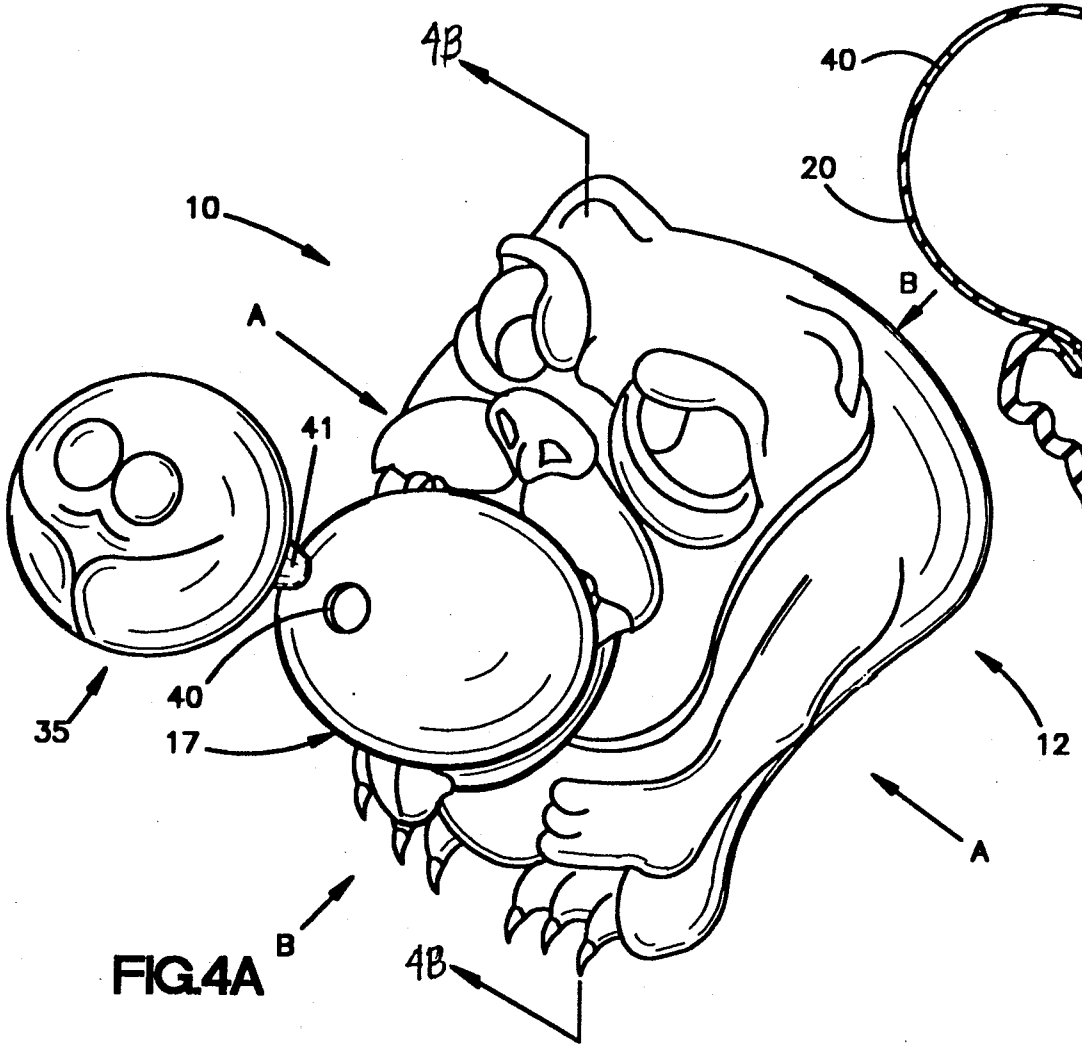
FIG. 4A is a perspective view of a toy shown in FIG. 1 with the body in a subsequent state of deformation and the projectile being ejected from the subcavity of the body.

In any case, when the body is squeezed hard enough, the wall 19 of the receptacle is forced outwardly through the mouth 25 and becomes located almost entirely outside of the body 12, as illustrated in FIGS. 4A, 4B. The attachment of the mouth area of the receptacle to the remainder of the body typically requires that a portion of the receptacle will remain within the main cavity. As the body 12 is squeezed, the mouth 25 expands slightly to a dimension which is slightly larger than the dimension of the projectile 35.

If the projectile 35 is located within the subcavity 20 when the body is squeezed, the projectile 35 is ejected from the subcavity as the wall 19 of the receptacle is forced outward through the enlarged mouth. The amount of squeezing pressure applied to the body determines the distance in which the projectile travels after being ejected from the subcavity. Because the mouth 25 forms part of the animated features of the toy, the projectile 35 appears to be "spit out" of the mouth of the toy 10 when the body is squeezed. Accordingly, the interrelation between the structural and animated features on the toy plays an important role in providing entertainment and amusement for children.

When the pressure on the toy body is released, the air pressure (or other fluid pressure) within the housing 15 is reduced and the body 12 returns to its original shape shown in FIGS. 1A, 1B. In that process, the mouth 25 returns to its initial dimension slightly smaller than the dimensions of the projectile 35. The receptacle 18 may also be drawn back within the body 12, however, if that does not occur, the receptacle 18 may be pushed into the main cavity of the body by hand. The toy body 12 will then be returned to its normal, undeformed configuration, ready to again receive the projectile 35.

The weight and durometer of the body and of the projectile in part determine the distance the projectile travels when the body is squeezed. It is preferred that in order for the projectile to be ejected a satisfactory distance, the body should have a weight of between about 85 to 105 grams, and that the body should have a Shore "A" durometer of about 60. The thickness of the wall 19 of the receptacle portion of the body should be slightly thinner than the thickness of the remainder of the body. Additionally, the projectile should have a weight of between about 9 and 10 grams, and a Shore "A" durometer of about 60. When the body and projectile are formed in this manner, the projectile travels a satisfactory distance outwardly from the body after the body is squeezed. The actual weight and durometer of the body and projectile can, of course, vary depending on the size of the body and the desired distance to eject the projectile.

According to an additional aspect of the invention, a hole may be formed in the receptacle 18 to prevent the toy from being used to eject objects other than the specially designed projectile 35. The hole 40 is designed to receive a wedge-shaped key 41 formed integrally with or attached to the projectile 35. Preferably the hole 40 is located toward the rear of the receptacle 18 so that when the projectile 35 is introduced into the subcavity, the key 41 can be easily pushed through the hole 40 in the receptacle.

When the hole 40 is plugged by the key 41, the air pressure within the body 12 increases in response to the deformation or squeezing of the body. The amount of pressure that develops within the main cavity of the body is in part a function of the close fit between the key 41 and the hole 40. It is believed that the key 41 is frictionally held within the hole 40 as the pressure increases within the body until the pressure becomes sufficiently high such that the wall 19 of the receptacle 18 is forced outward through the mouth 35. As the receptacle is forced outward through the mouth, the projectile (and key) are thus ejected from the toy.

According to this aspect of the invention, the mouth can be normally larger than the projectile—even when the body is in the undeformed state. It is not believed necessary to provide a mouth which is normally smaller than the projectile to retain the projectile in the receptacle because of the frictional fit between the key and hole. More particularly, the tight fit between the key and hole retains the projectile in the receptacle and prevents unwanted removal therefrom until the toy is squeezed.

In any case, if an object other than the projectile 25 is introduced into the subcavity 20 of the receptacle, for example a marble, the object will not properly plug the hole since it will not have the specially designed key. Hence, when the body is deformed, the air within the body will be expelled through the hole, rather than increasing the pressure in the body and forcing the receptacle through the mouth to eject the object.

Accordingly, the hole 40 in the receptacle 18 provides a feature that prevents objects other than the projectile 35 from being ejected from the toy. Additionally, it is believed that the key 41 improves the aiming of the flight of the projectile 35 by properly aligning the projectile with the mouth. The key member 41 also enables the animated features on the projectile 25 to be properly oriented so as to be visible through the mouth of the toy.

While the foregoing disclosure depicts the preferred embodiment, there are other ways for providing the features and advantages of the present invention. For example, the body can have other portions, e.g., ears, nose, eyes, etc., which can bulge outwardly when the body is deformed. To this end, these other portions can have a thickness which is slightly less than the thickness of the body, such that when the fluid pressure in the body increases, these portions bulge outwardly. Moreover, additional modifications of the present invention will become apparent to those of ordinary skill in this art.

What is claimed is:

1. A device for ejecting a projectile, comprising:

a projectile to be propelled away from said device a body formed of resiliently deformable material which defines a main cavity, a portion of said body forming a receptacle with a wall which normally extends inwardly into the main cavity and is at least partially enclosed by the remainder of said body, said receptacle having a mouth portion interconnecting said receptacle with the remainder of the body, said mouth portion being configured to frictionally engage said projectile when it is inserted through said mouth and located and supported in the receptacle and retained in said receptacle by said mouth, said receptacle wall forcing said projectile through the mouth and away from the body when said body is squeezably deformed.

2. A device as in claim 1, wherein said receptacle is normally configured to retain the projectile in the subcavity until the body is resiliently deformed.

3. A device as in claim 2, wherein said receptacle is normally configured to cause an interference fit with the projectile when the projectile is located in the subcavity until the body is resiliently deformed.

4. A device as in claim 3, wherein said mouth has a selected inner dimension, the inner dimension of said mouth being normally smaller than the outer dimension of said projectile when said body is not deformed, and being slightly larger than the outer dimension of said projectile member when said body is deformed to facilitate ejecting the projectile from the body.

5. A device as in claim 3, wherein said receptacle is forced at least partially outward through said mouth when said body is resiliently deformed to eject the projectile from the subcavity in the receptacle.

6. A device as in claim 5, wherein said receptacle has a thickness which is less than the thickness of the body to facilitate forcing said receptacle outwardly through said mouth when said body is deformed.

7. A device as in claim 3, wherein said body includes animated features formed on the outer surface thereof, and said mouth of said outer housing forms a part of said animated features.

8. A device as in claim 3, wherein said portion of said body forming the receptacle includes a hole connecting the subcavity in said receptacle with the main cavity of said body, the hole in said receptacle normally preventing said receptacle from being forced outwardly through said mouth when the body is resiliently deformed, and said projectile being configured to fill said hole when said projectile is located within the receptacle which causes said receptacle to be forced outwardly through said mouth when said body is deformed.

9. A device comprising:

a projectile, and a body formed of resiliently deformable material which defines a main cavity, a portion of said body forming a receptacle which normally extends inwardly into the main cavity and defines a subcavity, said receptacle having a mouth configured to allow the projectile to be located and supported in the subcavity of the receptacle and the receptacle being normally configured to retain and cause an interference fit with the projectile until the body is resiliently deformed, and to be ejected from the subcavity when said body is resiliently deformed, said body forming the receptacle including a hole connecting the subcavity in the receptacle with the main cavity of the body, the hole in the receptacle normally preventing the receptacle from being forced outwardly through the mouth when the body is resiliently deformed, and said projectile including a key integral therewith which is designed to be inserted within and plug the hole in said receptacle to enable said receptacle to be forced outwardly through said mouth when the body is deformed.

10. A device as in claim 9, wherein said key is formed in one piece with the projectile.

11. A device as in claim 10, wherein said projectile is formed from generally resilient material.

12. A device as in claim 10, wherein said body is fluid-tight.

13. A device as in claim 11, wherein said body is formed of PVC material.

14. A squeezable toy, comprising:

a projectile to be propelled away from said device;

a body formed of resiliently deformable material, said body defining a main cavity and having a receptacle with a wall configured to normally receive and support said projectile at least partially within the main cavity, said receptacle including a mouth having a configuration which requires the projectile to be forced through the mouth to frictionally engage the projectile in said receptacle and said receptacle wall being designed to be forced at least partially outward through said mouth when said body is squeezably deformed to eject said projectile outwardly away from and separated from the body.

15. A toy as in claim 14, wherein said receptacle is further designed to normally retain the projectile at least partially within the receptacle.

16. A toy as in claim 15, wherein said receptacle is normally configured to cause an interference fit with the projectile when the projectile is located in the receptacle until the body is resiliently deformed.

17. A toy as in claim 16, wherein said receptacle is responsive to increases in pressure within the cavity when said body is deformed to eject the projectile from the receptacle.

18. A toy as in claim 17, wherein said mouth enables the projectile to be received and supported in said receptacle, said mouth having a selected inner dimension which is normally smaller than the outer dimension of the projectile when the body is not deformed, and slightly larger than the outer dimension of the projectile when said body is deformed to enable the projectile to be ejected from the cavity.

19. A toy as in claim 16, wherein said body includes animated features visible on the outer surface thereof, and the mouth of the receptacle forms at least a part of the animated features.

20. A toy as in claim 16, wherein said receptacle includes an opening interconnecting the main cavity with ambient air pressure, the projectile being dimensioned to cover the opening in the receptacle when the projectile is received and supported in the receptacle to enable pressure to increase in the main cavity.

21. A device for ejecting a projectile, comprising:

a projectile to be propelled away from said device;

a body formed of resiliently deformable material having a first portion defining a main cavity, and a second a portion forming a receptacle with a wall normally extending inwardly into the main cavity and being at least partially enclosed by the first portion to define a subcavity within the main cavity, said receptacle having a mouth normally with a slightly smaller dimension than said projectile to require said projectile to be forced through the mouth to retain said projectile in the subcavity of the receptacle, and said mouth expanding to a slightly larger dimension than said projectile when said body is squeezably deformed to allow said receptacle wall to eject said projectile outwardly away from the body.

22. A device as in claim 5, wherein the receptacle is formed in one piece with the body.

23. A toy as in claim 19, wherein the receptacle is formed in one piece with the body.

24. A toy as in claim 20, wherein said projectile has a key integral therewith which is designed to be inserted into and plug the opening in the receptacle to enable the receptacle to be forced outwardly through the mouth when the body is deformed.

25. A device as in claim 21, wherein the receptacle includes an opening connecting the cavity with ambient air pressure, said projectile having a key integral therewith which is designed to be inserted into and plug the opening in the receptacle to enable the receptacle to be forced outwardly through the mouth when the body is deformed.

26. A device as in claim 25, wherein the receptacle is formed in one piece with the body and is forced at least partially outward through said mouth when said body is resiliently deformed to eject the projectile from the subcavity in the receptacle.

27. A toy, comprising:

a projectile to be propelled away from said device;

a body formed of generally resiliently deformable material having a main body portion which defines a main cavity, and a minor body portion which forms a receptacle with a wall normally extending inwardly into the main cavity of the main body portion and being at least partially enclosed by said main body portion, said main body portion having a ball-like configuration and an outer surface with a fanciful configuration, and said receptacle having a mouth configured to frictionally engage said projectile when it is forced into said receptacle and to be located, supported and retained in the receptacle and to be ejected outwardly away from the body of the toy by the receptacle wall when said body is squeezably deformed.

* * * * *